US005988036A

United States Patent [19]

Mangolds et al.

[11] Patent Number: 5,988,036

[45] Date of Patent: Nov. 23, 1999

[54] BALLISTICALLY DEPLOYED RESTRAINING NET SYSTEM

[75] Inventors: Arnis Mangolds, Stow; Michael David Farinella, Mansfield; Daniel Rene Deguire, Blackstone; Robert Lee Cardenas, Framingtham, all of Mass.

[73] Assignee: Foster-Miller, Inc., Waltham, Mass.

[21] Appl. No.: 09/229,696

[22] Filed: Jan. 13, 1999

Related U.S. Application Data

[60] Division of application No. 08/866,745, May 30, 1997, Pat. No. 5,898,125, which is a continuation-in-part of application No. 08/544,012, Oct. 17, 1995, Pat. No. 5,750,918.

[51] Int. Cl.[6] ..... F42B 33/00

[52] U.S. Cl. ..... 86/1.1; 29/1.2; 89/1.11; 102/502

[58] Field of Search ..... 102/293, 502; 29/1.2, 1.22, 1.23; 86/1.1; 89/1.11

[56] References Cited

U.S. PATENT DOCUMENTS

| | | | |
|---|---|---|---|
| 1,309,530 | 7/1919 | Lamberson | 102/504 |
| 2,251,918 | 8/1941 | Dawson | 102/504 |
| 3,710,720 | 1/1973 | Mawhinney | 102/502 |
| 4,253,132 | 2/1981 | Cover | 361/232 |
| 4,768,417 | 9/1988 | Wright | 89/1.11 |
| 4,912,869 | 4/1990 | Govett | 89/1.11 |
| 5,326,101 | 7/1994 | Fay | 102/504 |
| 5,583,311 | 12/1996 | Rieger | 102/504 |
| 5,698,815 | 12/1997 | Ragner | 102/502 |

FOREIGN PATENT DOCUMENTS

| | | | |
|---|---|---|---|
| 859282 | 12/1940 | France | 102/504 |
| 2166225 | 4/1986 | United Kingdom | 89/1.34 |

*Primary Examiner*—Harold J. Tudor
*Attorney, Agent, or Firm*—Iandiorio & Teska; Brian J. Colandreo

[57] ABSTRACT

A ballistically deployed restraining net system including a cartridge receivable within a barrel, the cartridge having a base and an opposing open end. There is a restraining net packaged in the cartridge and a set of weights attached to the restraining net and packaged within the cartridge between the base of the cartridge and the restraining net. A deployment charge ejects the restraining net and the set of weights out of the barrel and out of the cartridge and a spreader charge deploys the weights after the net and the set of weight exit the cartridge so that the weights overtake the net in flight.

3 Claims, 13 Drawing Sheets

BALLISTICALLY DEPLOYED RESTRAINING NET SYSTEM

RELATED APPLICATIONS

This is a division, of application Ser. No. 08/866,745, filed May 30, 1997, now U.S. Pat. No. 5,898,125 which is a continuation-in-part of U.S. Ser. No. 08/544,012 filed Oct. 17, 1995, now U.S. Pat. No. 5,750,918 entitled "Ballistically Deployed Restraining Net."

FIELD OF INVENTION

This invention relates to a ballistically deployed restraining net system in which a restraining net is packaged in a projectile and unfurled in flight proximate the target to be restrained.

BACKGROUND OF INVENTION

There are a number of less than lethal weapons currently used by law enforcement and military personnel including tear and pepper gas sprays and bombs. These types of weapons, however, are not always effective especially when perpetrator or enemy personnel are armed. These types of weapons also sometimes fail to adequately restrain the target. Some prior restraining net systems have been developed (see, e.g., U.S. Pat. No. 4,912,869), but they require either specialized launching guns, have very short ranges, and/or are susceptible to entanglement on obstructions in the path between the launching gun and the target.

Law enforcement and military personnel are not usually receptive to restraining net systems which require specialized launching guns. Such systems are also cost prohibitive since the design and production costs of the launching gun are excessive. Also, restraining net systems wherein the net is deployed in its open state do not have much of a range because of the drag of the net in flight. Moreover, it is difficult to aim these types of weapons. Such systems are also easy to elude. Worse, the net in its open unfurled state can become entangled on obstructions (e.g. tree branches) in the path between the net launcher and the perpetrator. Finally, prior restraining net systems are ineffective at restraining hostile and/or armed individuals.

SUMMARY OF INVENTION I

It is therefore an object of this invention to provide an improved ballistically deployed restraining net system.

It is a further object of this invention to provide such a system which can be used in conjunction with standard issue weapons.

It is a further object of this invention to provide such a system which has a very long range.

It is a further object of this invention to provide such a system in which the net avoids entanglement on objects in the path between the launcher weapon and the target.

It is a further object of this invention to provide such a system which is effective at restraining hostile and/or armed individuals.

It is a further object of this invention to provide such a system which can be designed to temporarily incapacitate as well as restrain a hostile individual.

It is a further object of this invention to provide such a system in which large area nets can be packaged in very small containers.

It is a further object of this invention to provide an effective method for ballistically deploying a restraining net.

It is a further object of this invention to provide an effective method of packaging a restraining net for deployment.

This invention results from the realization that the range, effectiveness, and safety of a ballistically deployed restraining net can be increased by packaging the restraining net weights in back instead of in front of the restraining net. The range of the net is increased because the weight spreader charge does not act against the restraining net. Safety is increased because, should the spreader charge fail, the weights will not directly impact the target.

This invention results from the further realization that the effectiveness of a ballistically deployed restraining net used outdoors can be increased by attaching the weights to the net via leader lines instead of directly to the perimeter of the net thus increasing the "bola" action of the device.

This invention results from the further realization that the effectiveness of a ballistically deployed restraining net used indoors or in close quarters can be increased by attaching the weights to the interior sections of the restraining net to reduce the chance that a weight will strike an object in the path of the target.

This invention results from the further realization that a 16 foot diameter restraining net can be packaged within a 37 mm cartridge if the net is compressed both longitudinally and circumferentially within a compression jig.

This invention features a ballistically deployed restraining net system. There is a cartridge receivable within a barrel, the cartridge having a base and an opposing open end. A restraining net is packaged in the cartridge. A set of weights are attached to the restraining net and packaged within the cartridge between the base of the cartridge and the restraining net. There are deployment means (e.g. a deployment charge) for ejecting the restraining net and the set of weights out of the barrel and out of the cartridge. Finally, there are spreader means (e.g. a spreader charge) for deploying the weights after the net and the set of weights exit the cartridge. Thus, the net is ejected first and the weights then spread out and overtake the net to eliminate any forces acting on the net against its intended direction of travel. This also makes the device safer: if the spreader charge fails, the net rather than the weights will strike the target first.

The cartridge typically includes a primer in communication with the deployment charge. Further included are delay means (e.g. a delay fuse) in communication with the deployment charge and the spreader charge for initiating the spreader charge after a time delay of the initiation of the deployment charge.

In a preferred embodiment, a plug, receivable within the cartridge proximate the base portion, includes a cavity on surface thereof for housing the deployment charge. The plug includes the spreader charge on another surface thereof and an orifice therethrough in communication with both surfaces for housing the delay fuse. The onepiece plug design aids in manufacturing efficiency.

To increase the "bola" action of the weights, the weights are attached to the restraining net via leader lines. The leader lines may be attached to the perimeter of the restraining net, or in some cases, for example, indoor applications, the leader lines are attached to interior sections of the restraining net.

In a preferred embodiment, there is a housing for the restraining net and the housing includes perforations for facilitating deployment of the restraining net. The weights may be made of rubber, lead, or a metal surrounded by rubber exterior.

In a sting net design, the net includes a power source and an open electrical circuit connected to the power source for disabling a target captured in the net. The net may also include a disabling adhesive, a disabling chemical, and/or a marking substance.

In a broader sense, this invention features a capture system comprising a capture device and a set of weights, wherein initially, the capture device is deployed before the weights. The capture device may be a restraining net or a capture film and the weights are subsequently deployed to overtake the capture device.

This invention also features a method of ballistically deploying a restraining net system. The method comprises packaging a restraining net and a set of weights attached to the restraining net within a cartridge such that the weights are located between the base of the cartridge and the restraining net; ejecting the restraining net and the set of weights out of a barrel and out of the cartridge; and deploying the weights after the net and the set of weights exit the cartridge. The step of ejecting includes placing a deployment charge between the base of the cartridge and the set of weights. A primer is usually located in communication with the deployment charge. Deploying includes placing a spreader charge between the deployment charge and the set of weights. The weights are deployed after a time delay after the ejection of the restraining net.

This invention also features an efficient method of packaging a restraining net. The method comprises attaching weights to the restraining net; drawing the net longitudinally within a lengthy hollow member such as a tube; and compressing the net longitudinally and circumferentially into a bullet shape using a compression jig. A separator unit is used to maintain the proper orientation of the weights during packaging. The step of compressing the net includes using a plunger receivable within the hollow member. To compress the net circumferentially, it is removed from the hollow member and placed in a press.

The ballistically deployed capture system of this invention includes a cartridge receivable within a barrel, the cartridge having a base and an opposing open end; a capture device such as a restraining net or a capture film packaged in the cartridge; a set of weights attached to the capture device and packaged within the cartridge between the base of the cartridge and the capture device; deployment means for ejecting the capture device and the set of weights out of the barrel and out of the cartridge; and spreader means for deploying the weights after the capture device and the set of weights exit the cartridge.

DISCLOSURE OF PREFERRED EMBODIMENT

Figure 1:
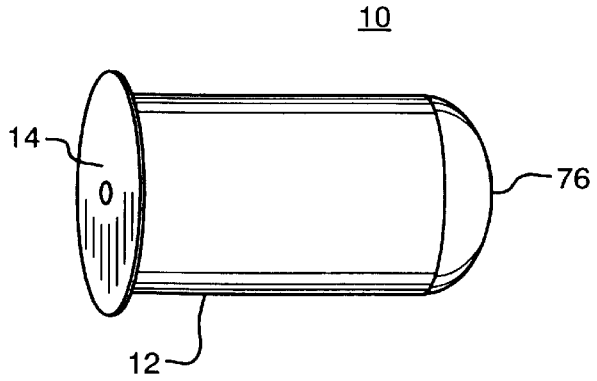
FIG. 1 is a schematic view of the restraining net system of this invention within a cartridge.
Figure 4:
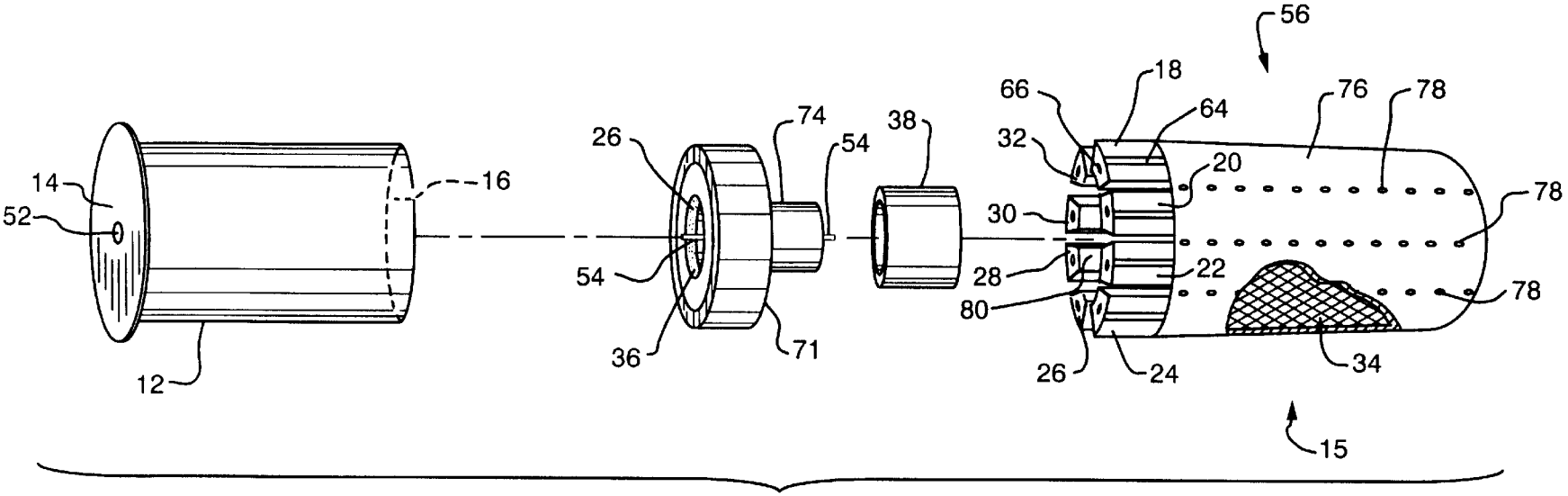
FIG. 4 is an exploded schematic view of the ballistically deployed restraining net system show in FIG. 1.

Ballistically deployed restraining net system 10, FIG. 1, of this invention includes cartridge 12 having a base 14 and opposing open end 16, FIG. 4. Projectile 15 includes weight set 18, 20, 22, 24, 26, 28, 30, and 32 and eight other weights (not shown) attached to restraining net 34 within casing material 76. Projectile 15 is packaged within cartridge 12 with the weight set proximate the base portion of the cartridge. Deployment means, such as a deployment charge in the form of ten grains of gun powder 36, FIG. 4, eject restraining net 34 and weights 18–32 out of cartridge 12 which is fired from a 37 millimeter smooth bore tear gas gun. Spreader means or a spreader charge in the form of five to ten grains of flash mix deploys weights 18–32 after they and net 34 exit the open end 16 of cartridge 12. Alternatively, cartridge 12 may be eliminated if a flare gun such as a 35 mm Smoke Gun Buck Werke Gmblt & Co. Model DM34 is used.

Thus, one unique feature of the subject invention is that the set of weights 18–32 are packaged in back of instead of in front of the restraining net which surprisingly results in an increase of the range of the restraining net. Moreover, the safety of the restraining net system is increased because, should spreader charge 38 fail to fire, the net package will strike the target or perpetrator first rather than the weights as in previous designs.

Figure 2:
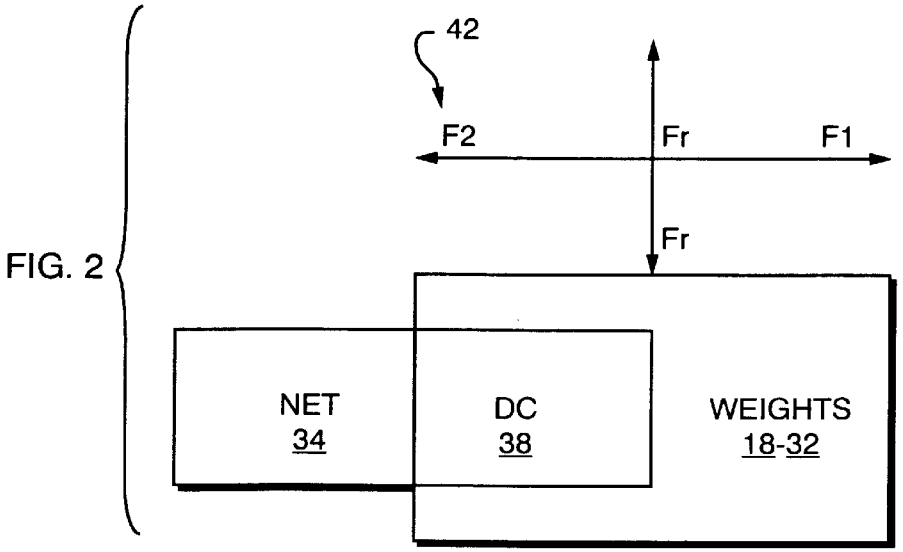
FIG. 2 is a force diagram showing the forces acting on a prior art restraining net when the perimeter weights are packaged in front of the restraining net.
Figure 3:
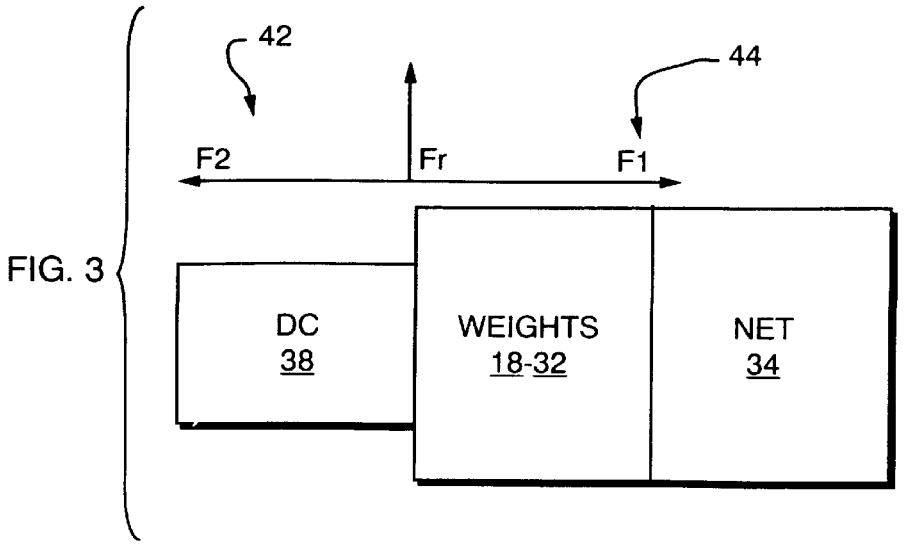
FIG. 3 is a force diagram depicting the forces acting on the restraining net system of this invention wherein the perimeter weights are packaged in back of the restraining net.

As shown in FIG. 2, spreader charge 38, used to separate the weights when they are located in front of net 34, has a force F2 shown at 42 which acts against net 34 thereby decreasing its travel range. When, however, net 34 is located in front of weights 18–32, force F1 from spreader charge 38 as shown at 44, FIG. 3, urges net 34 forward and force F2 as shown at 42 also propels net 34 forward. Thus, there are no forces acting against the intended direction of travel of net 34.

Figure 5E:
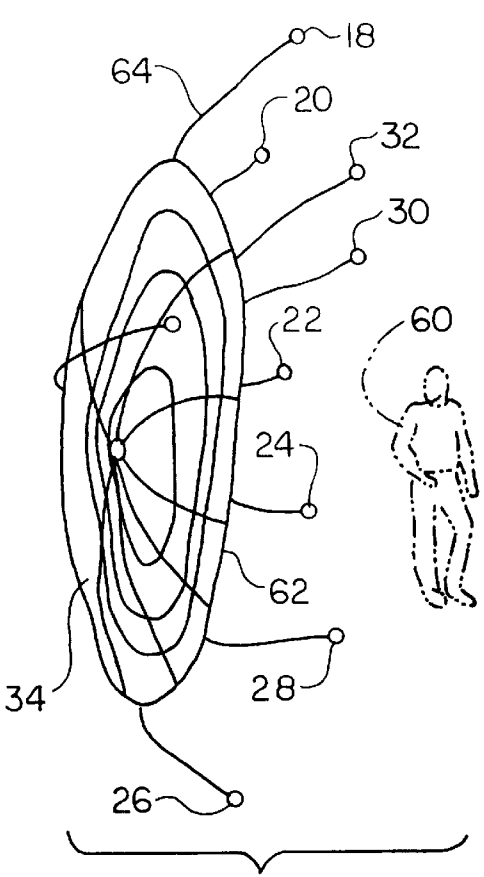
FIGS. 5A–5E are schematic views showing the deployment of the restraining net system according to this invention.
Figure 5D:
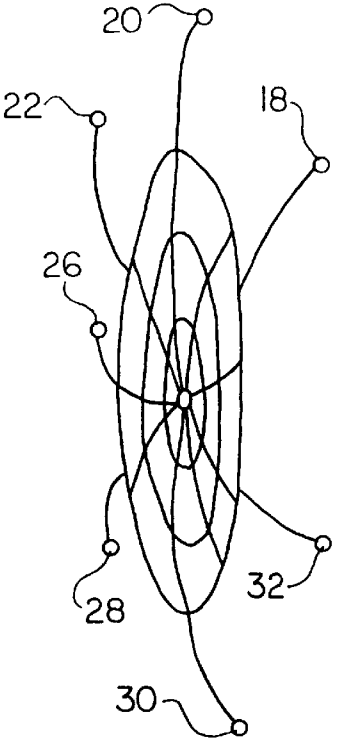
Figure 5C:
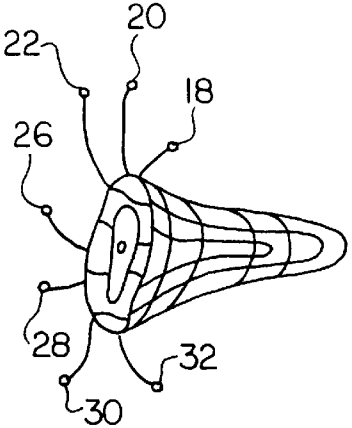
Figure 5B:
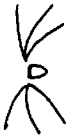
Figure 5F:
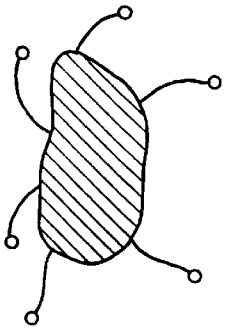
Figure 5A:
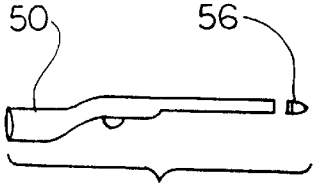

In operation, the hammer of gun 50, FIG. 5A, strikes primer 52, FIG. 4, of cartridge 12 which in turn ignites deployment charge 36 and delay fuse 54. The explosion of deployment charge 36 ejects the combination of weight and net package 56, FIG. 4, and approximately 20 to 30 milliseconds thereafter, as shown in FIG. 5B, delay fuse 54, FIG. 4, ignites spreader charge 38 which spreads out weights 18–32 as shown in FIG. 5C. As shown in FIG. 5D, weights 18–32 are now fully deployed and as shown in FIG. 5E, net 34 is fully deployed as weights 18–32 accelerate ahead of net 34. Full deployment of net 34 occurs within about 5 feet of gun 50, FIG. 5A. The effective capture zone for capturing perpetrator 60 is approximately 25 additional feet after full deployment at 5 feet. This increased range is an improvement over prior devices wherein the weights are always packaged in front of the capture net. And, as explained above, should spreader charge 38, FIG. 4 fail to fire, net 34 will strike perpetrator 60, FIG. 5E first rather than weight set 18–32.

Another significant advantage of the subject invention is that weights 18–32 are not attached directly to the perimeter 62, FIG. 5E of net 34 but instead are attached via 3 foot long leader lines 64 as shown for weight 18. These leader lines act in a "bola" like fashion to improve the effectiveness of the restraining net system. In the embodiment shown in FIG. 5E. the leader lines are attached to the perimeter 62 of ten foot diameter net 34. Weights 18–32, FIG. 4, are made of lead, rubber such as "Ultra High Mass" rubber available from the Griffiths Rubber Co. 2625 NW Industrial Portland, Oreg. 97210, are fabricated of a lead core covered in rubber, or are made up of bean bag type structures. Each lead weight, as shown for weight 18, has a hole through it as shown at 66 for attaching leader line 64 to the perimeter weight. In the preferred embodiment, the net is cut into an octagon shape and there are 16 weights, one attached to each corner of the octagon shaped net on one inch leader lines and one disposed between the corners on two foot leader lines. The short leader line weights function to deploy the net and the long leader line weights function to assist in the capture of the perpetrator via a bola type action.

In the preferred embodiment, plastic plug 70 houses both deployment charge 36 and spreader charge 38. Plug 70 is receivable within cartridge 12 proximate base portion 14 thereof. Plug 70 includes cavity 72 for housing deployment charge 36. Spreader charge 38 is received on post 74 of plug 70 and there is an orifice through this post through which delay fuse 54 is received. The one piece design of plug 70 facilitates the efficiency of manufacturing the ballistically deploying net system of this invention.

Net 34, FIG. 4, is packaged within cardboard or heat shrinkable plastic housing 76 which may perforated as shown at 78 for assisting in its separation upon the ignition of spreader charge 38. When packaged within cartridge 12, housing 76 is rendered nearly flush with the open end 16 of cartridge 12 as shown in FIG. 1. Orifice 80 created by the circle of weights 18–32 receives spreader charge 38. Weights 18–32 rest on surface 71 of plug 70.

Figure 6:
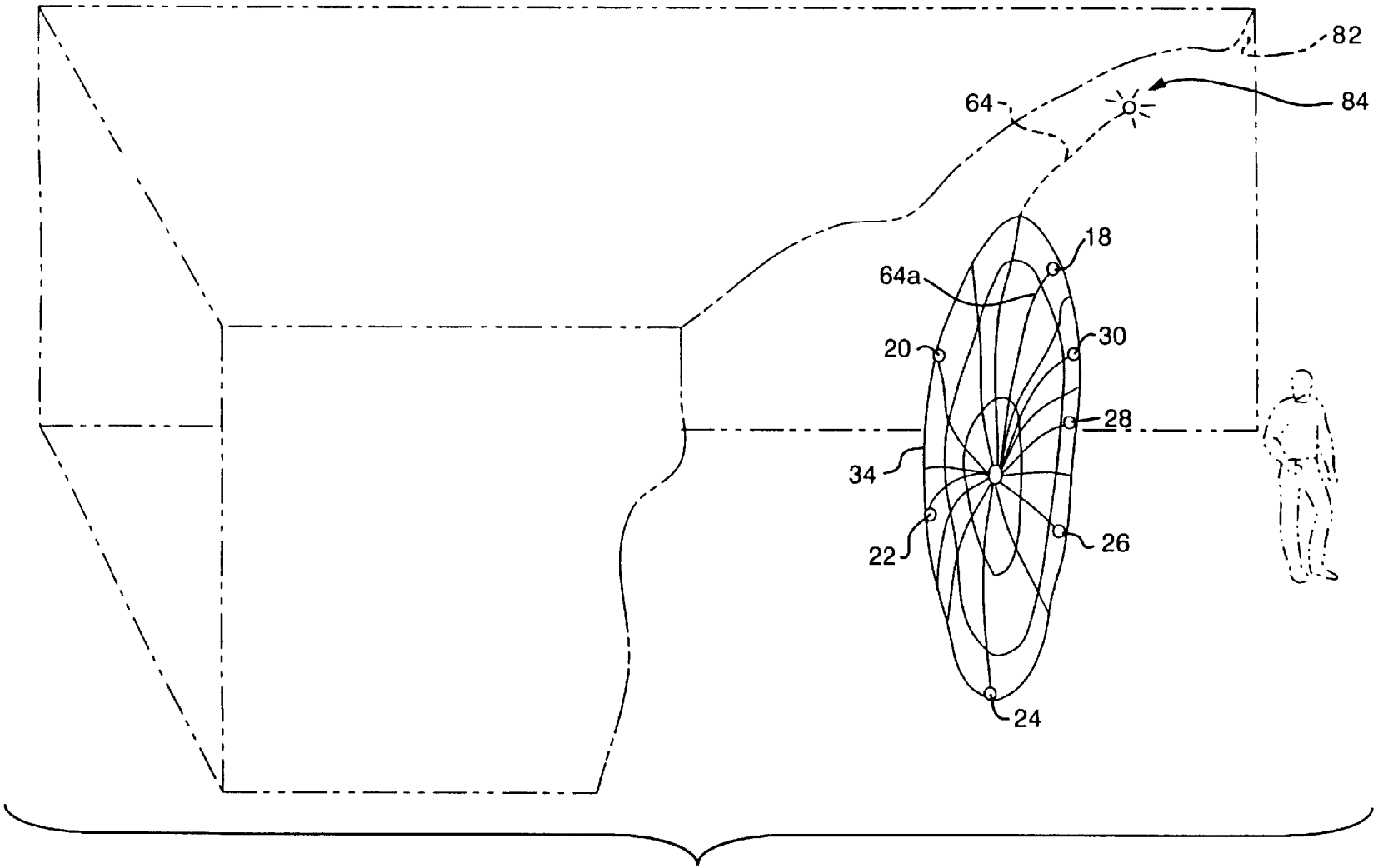
FIG. 6 is a schematic view showing another embodiment of the restraining net system of this invention wherein the perimeter weights are tied to the interior sections of the net to reduce the chance that the weights will strike an object in the path of the target.

In another embodiment, FIG. 6, the perimeter weights 18, 20, 22, 24, 26, 28, and 30 are attached to net 34 such as they do not extend beyond the perimeter of the capture net. Thus, leader line 64*a,* as shown for perimeter weight 18, is attached somewhere near the center of net 34 rather than at the perimeter as shown in phantom for close quarters or indoor maneuvers wherein the action of a perimeter weight striking surface 82 as shown at 84 would tend to collapse or tangle net 34. The "Ultra High Mass" rubber weights used in the preferred embodiment also reduce the chance that a given weight will bounce off surface 82. Net 32 may be fabricated from a lightweight, high strength twine or braided cord of nylon, Spectra or Kevlar. The Spectra and Kevlar materials have the advantage of high strength to weight, and low weight to volume ratios thus allowing a relatively large net with adequate line strength to be packaged into munitions for hand held launchers such as 37 mm and 40 mm caliber weapons.

Cord breaking strengths on the order of 50 to 100 lbs are used for the personal capture nets. The net diameter and mesh size can be optimized for different munitions. Personal capture nets range in diameter from 10 feet to 16 feet with a mesh size ranging from 3 inches to 8 inches. In a preferred embodiment, vectran netting available from FNT Industries, Inc., 927 First St., Menominee, Mich. 49858-0157 is used and cut into an octagon shape 16 feet in diameter. This material allows the net to be tightly compressed within housing 76, FIG. 4, without the separate parts of the net sticking to each other.

The nets are a knotted construction with a knot at each node or line intersection. The net knots are single knot square mesh netting knots, the perimeter line knots are single overhand knots and the pull point knots are "double overhand" knots. Some materials, such as Spectra, may require a double knot at each node.

The weights can be fabricated from any material which will provide the mass to fully deploy the net, provide forward momentum for sustained flight and enough momentum to swing the net around the target and become entangled.

The net can be incorporated with one or more "sting" circuits to shock and disable a perpetrator. A power source 180, FIG. 7, such as a 6-volt battery, supplies current to sting circuits 182, 184, and 186 to provide open 50 kv electrical circuits integral within net 34, FIG. 5E. DC/DC voltage converter generator 181 with a step-up transformer and full wave bridge rectifier converts the battery voltage and charges energy storage capacitor 184 to an intermediate voltage of 500 to 1000 V. Microcontroller 186 provides the ability to sequentially activate several electronic switches to channel the energy in storage capacitor 184 through a step-up transformer to wiring in the net. Several independent output circuits 182, 184, 186 each driven by one of the electric switches provide redundancy in case one or more of the circuits in the net is shorted or broken.

Arming circuit 128 activates the sting circuit only after the net has been unfurled. Primary power is provided to first stage dc/dc converter 181 that produces an intermediate voltage of about 1000 VDC and powers the individual sting circuits 182, 184, and 186. Power is also sent to the lethality level selector and controller 186. Circuit 186 controls the pulse rate and voltage level of the individual sting circuits. Capacitor 184 maintains energy storage in the intermediate voltage supply system. Sting circuits 182, 184, and 186 step the final voltage level up to 2 kV to 100 kV, depending on the level selected. Should one of the HVP outputs become shorted, the other circuits will continue to operate independently.

Figure 7:
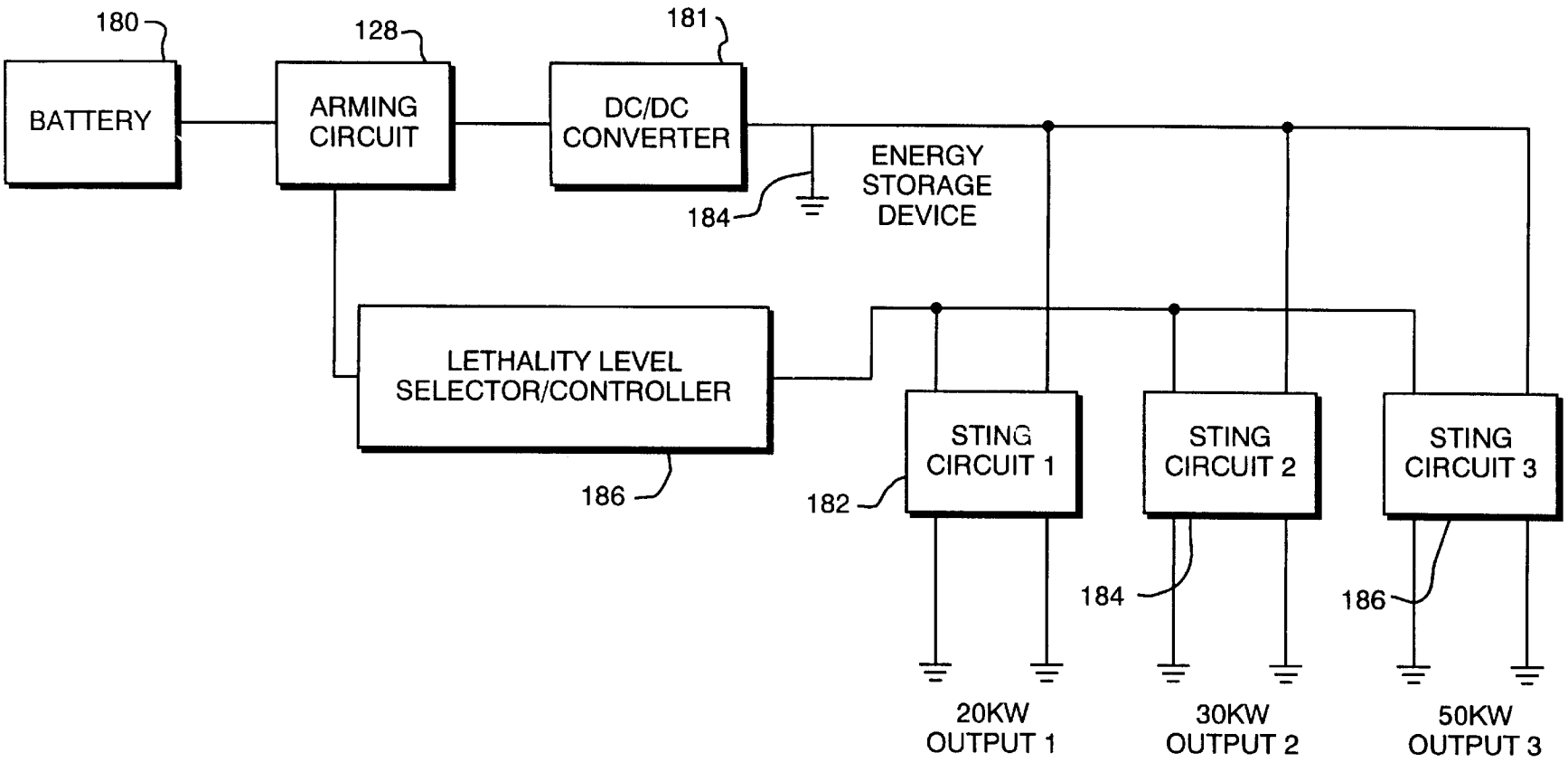
FIG. 7 is a block diagram of a sting net circuit component for the restraining net system of this invention.
Figure 8:
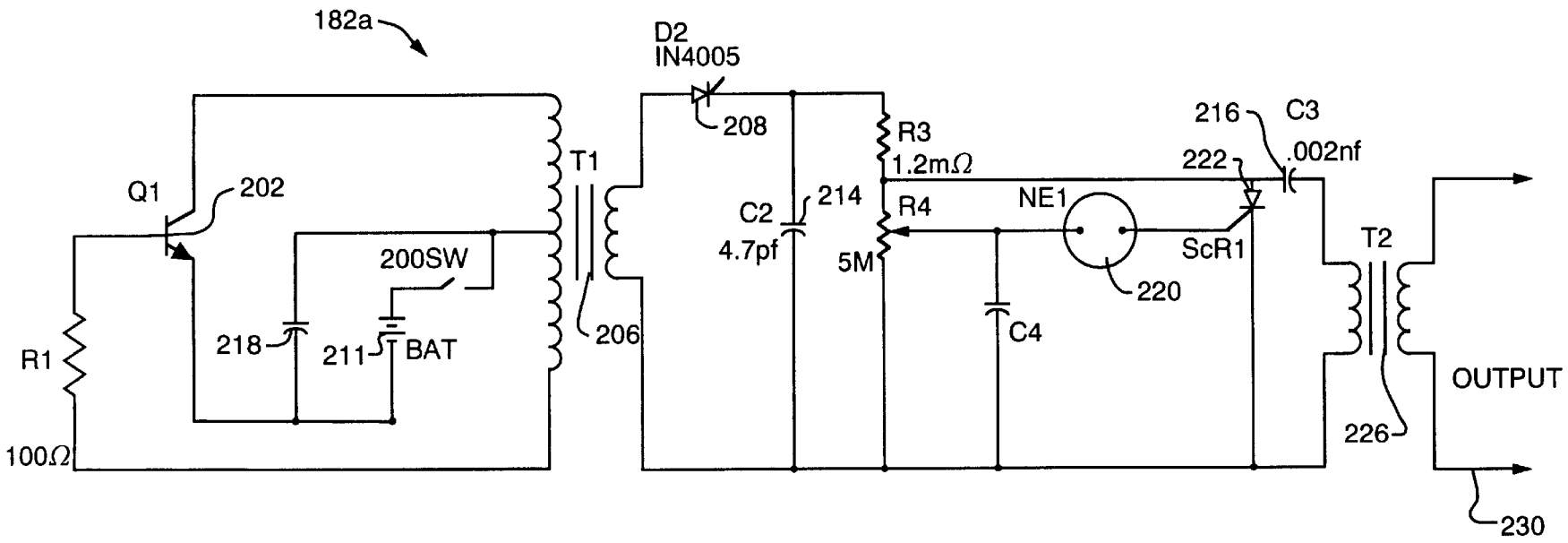
FIG. 8 is a circuit diagram of one embodiment of the sting circuit shown in FIG. 7.

The operation of the non-tunable circuit 182*a,* FIG. 8, is as follows. During deployment, on/off switch 200 is automatically closed by arming circuit 128, FIG. 7 and power from battery 201 is applied to the circuit. Transistor 202, FIG. 8, together with transformer 206 form a self-oscillating DC-DC converter. The output of the converter is a transformer which produces a 400 V AC signal across the diode 208. The output diode 208 is a half wave rectifier that converts the waveform back to a DC waveform of 200 V peak. As the electrical voltage rises across SCR 222, neon gas source 220 ionizes causing SCR 222 to turn on thereby discharging the voltage across transformer 226 which produces a 2000 V charge at the output 230.

Figure 9:
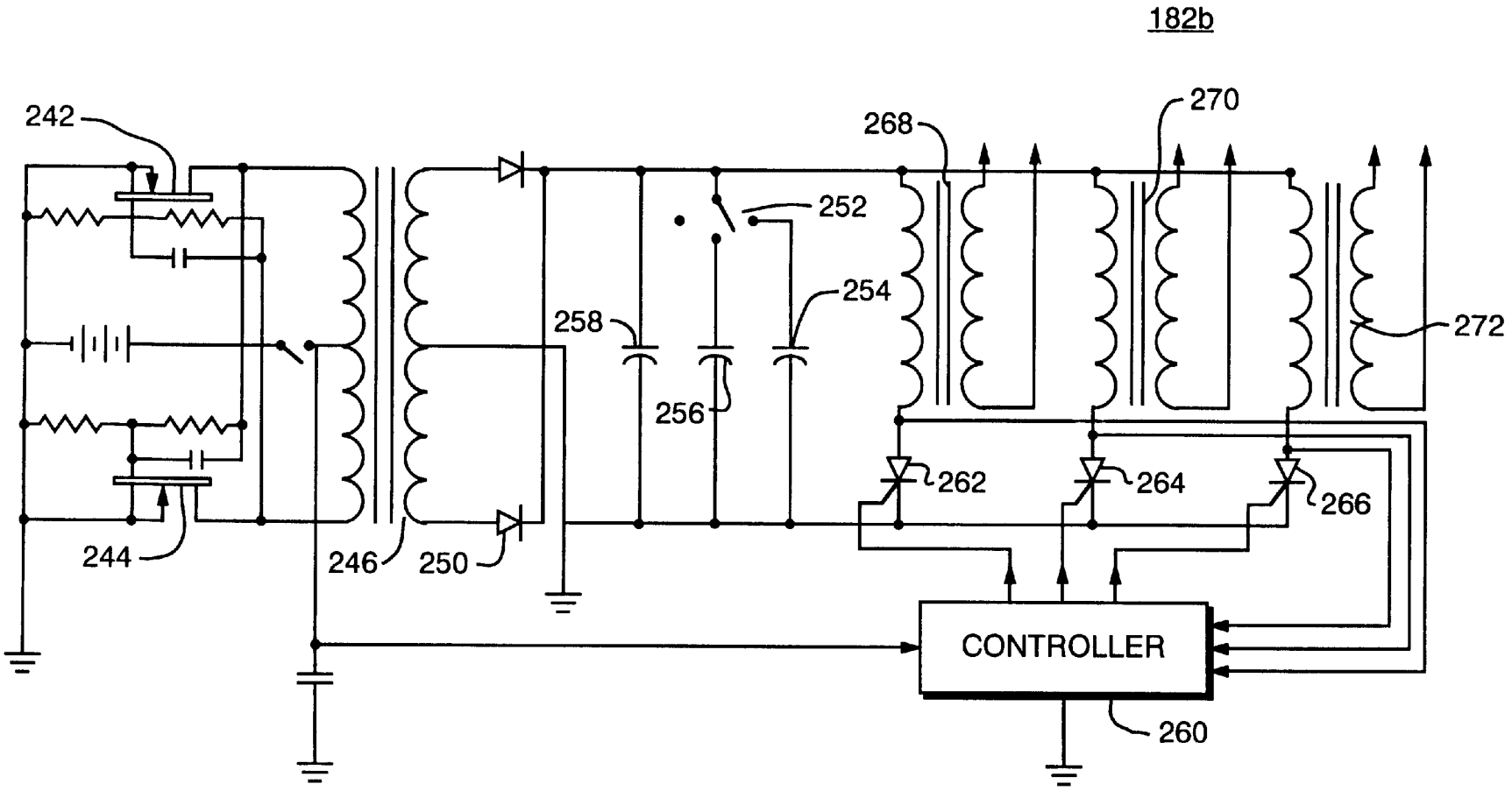
FIG. 9 is a circuit diagram of another embodiment of the sting circuit shown in FIG. 7.

Tunable sting circuit 182*b,* FIG. 9, produces extremely high voltages varying from 2 kV to 100,000 kV, at repetition rates between 1 and 20 pulses per second. The high voltage output pulse of circuit 182*b* is tunable prior to deployment to deliver different voltages to a perpetrator based on the circumstances. Circuit 182*b* provides a shock for 5 to 15 seconds, then turns off for 1 to 3 minutes before shocking again. This cycle will continue for up to 30 minutes or until the batteries die. A set of metal electrodes are incorporated into the net to apply the shock to the body.

During deployment, on/off switch 240 is automatically closed by arming circuit 128 to supply battery power to transistors 242 and 244 which, together with transformer 246, form a self-oscillating DC-DC converter. The output of the converter is a step-up transformer which produces a 2000 V AC signal across the secondary winding of transformer 246. Diodes 248 and 250 form a full-wave rectifier that converts the waveform back to a DC waveform of 1000 V. The transformer is sized to limit the current available at its output. The amount of energy available for each high voltage pulse is determined by the value of storage capacitance. Switch 252 permits capacitators 254 and 256 to be connected in parallel with capacitor 258 thereby increasing the duration of the output pulse. Periodically, microcontroller 260 triggers SCRs 262, 264 and 266, thereby completing a resonant circuit consisting of a capacitor 258 and the inductance of the primary winding of the step-up transformers 268, 270 and 272, etc. The output voltage is a decaying oscillation of peak magnitude of 2 to 100,000 kV with an oscillation frequency and pulse duration determined by the chosen position of switch 252. The user will have the option to disable the sting circuit prior to firing should the situation not warrant its use.

Figure 10:
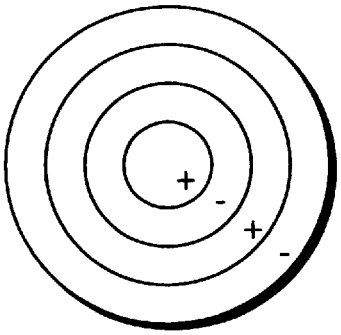
FIGS. 10–15 are schematic views of the various net wiring configurations for the sting circuits shown in FIGS. 8 and 9.
Figure 11:
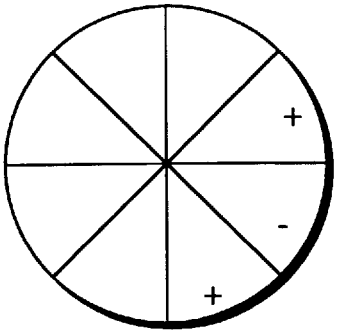
Figure 12:
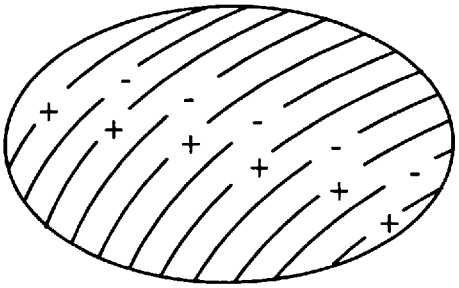
Figure 13:
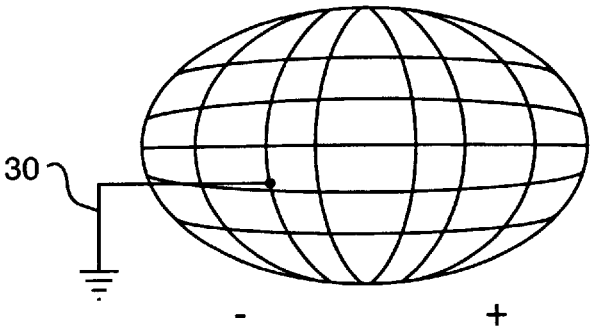
Figure 14:
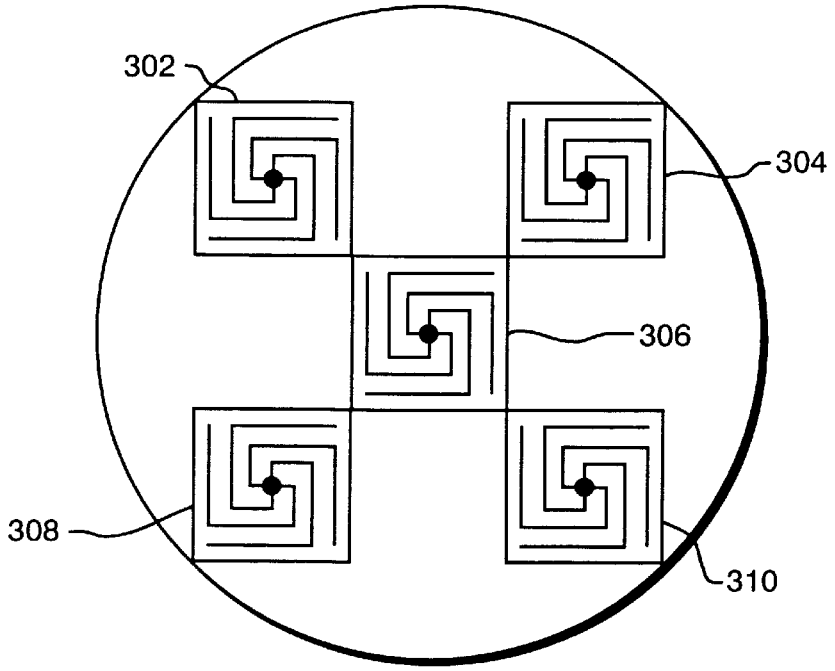
Figure 15:
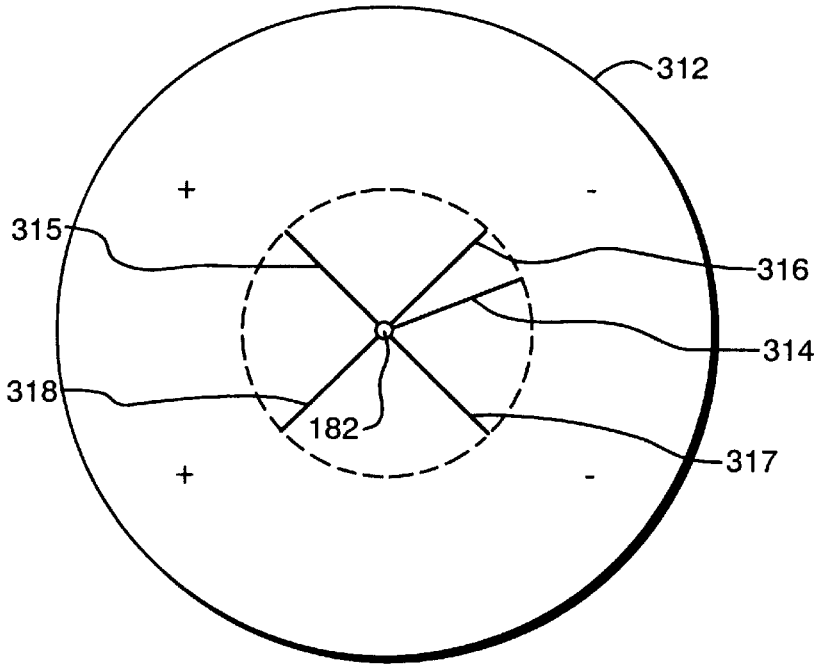

The output from sting circuits 182, 184, and 186, FIG. 7, may be arranged as wires forming alternating concentric rings as shown in FIG. 10, as alternating pie slices as shown in FIG. 11, or as alternating lines as shown in FIG. 12. In one embodiment, net 34, FIG. 13, may be used as a blockade in the form of an electric fence, with additional grounding wire 300. Another design includes 9 ft. square circuits 302, 306, 308, 310, FIG. 14 and, each with four spirals spaced 4 inches apart. Still another design includes an 11 foot diameter net 312, FIG. 15 with electronic circuit 182*b* (FIG. 9) potted in elastomer package 314 at the apex of net 312. Leads 315, 316, 317 and 318 extend as shown.

In another embodiment, a capture film is used as the capture medium rather than a net. Alternatively, films may be incorporated into a net for the purposes of aiding deployment, sustaining opened flight, and for the purpose of reducing the visibility of the target, thereby adding to confusion and enhancing entanglement and increasing escape times.

The film is constructed of light weight, thin (<0.001 in.) polymer materials, optionally coated with reflective aluminum powder. The film is attached in layers on the leading edge in a series of concentric rings forming air passage which minimize aerodynamic drag. The films are also independent of the mesh therefore acting as a secondary barrier against escape. This independent construction where the film is on the outside prevents self entanglement of the law enforcement officer.

Any number of markers foams, gaseous, liquid or power based markets, irritants or incapacitants can be incorporated into the net such as chloroacetophenone (CN), orthochlorobenzal-malononitrile (CS), oleoresin capsicum (OC), or their blends. Also a variety of UV or visual markers and dyes can be used. Sticky foam or other structural adhesives can be applied and in application, the net is encased in a polymer sock and sealed around the spreader gun. The net is stored in the adhesive. During deployment, the spreader gun ruptures the sock and spreads the net which is coated with the adhesive, irritant, or marker. High vapor pressures in the hermetically sealed sock maintain the viscous nature of the net coatings such that shelf life is greatly enhanced. In those embodiments which require vaporization the large surface area of the net and rapid expansion volatizes the carrier compounds. The direct contact with the target concentrates the effect and therefore permits minimal use of the irritants, and limits unwanted migration and collateral damage.

Figure 16:
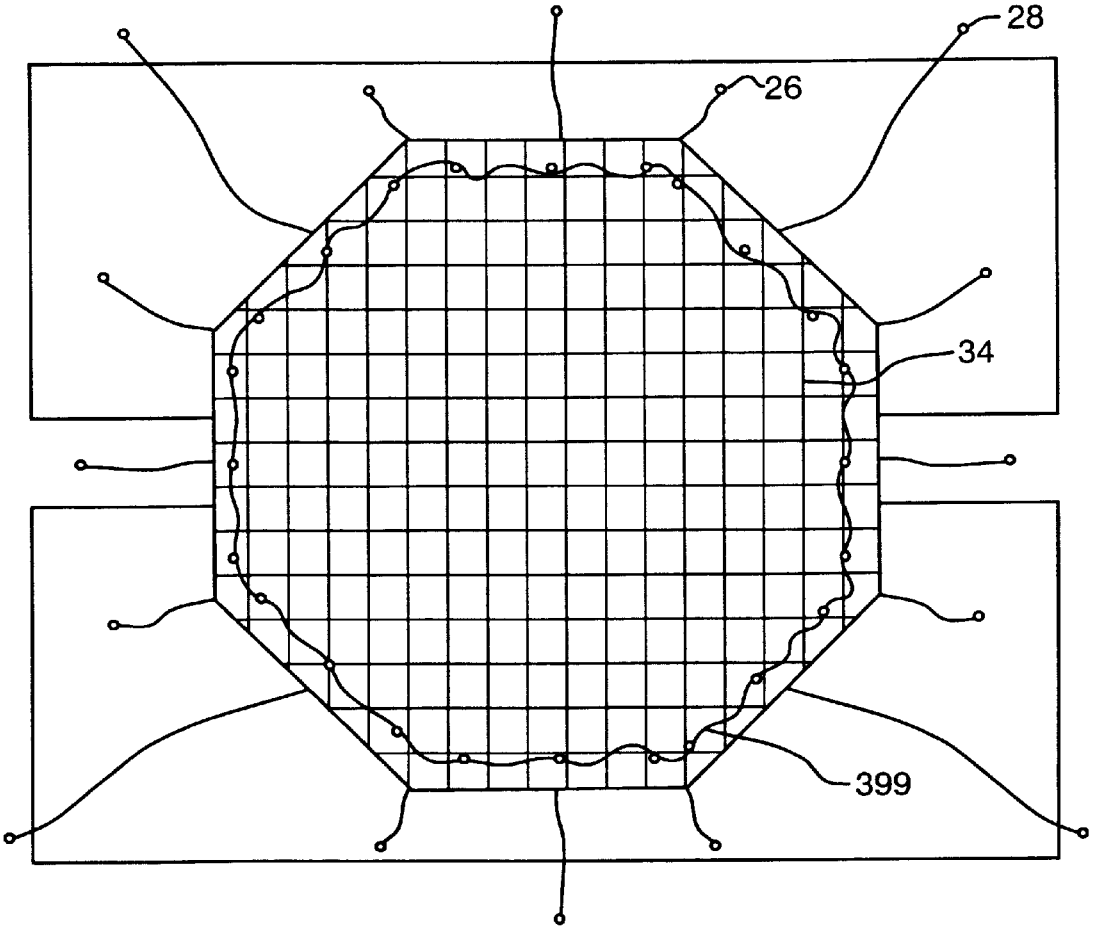
FIG. 16 is a top view of the initial net packaging layout in accordance with this invention.
Figure 18:
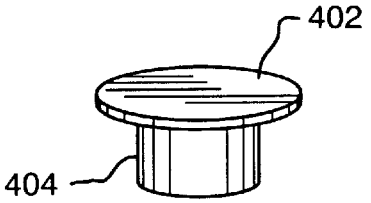
FIG. 18 is a schematic view of the bottom ring of the separator unit shown in FIG. 17.
Figure 21:
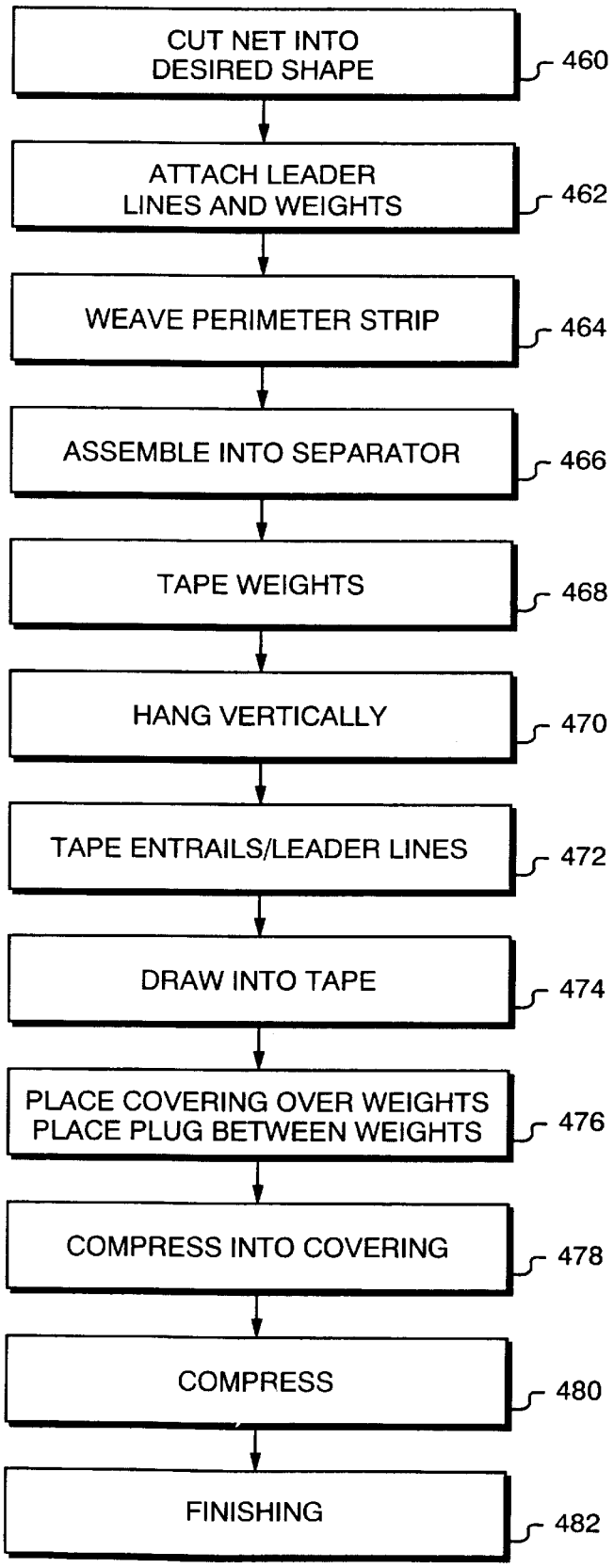
FIG. 21 is a flow chart depicting the major steps involved in packaging the restraining net for deployment in accordance with this invention.

Projectile 56, FIG. 4, is packaged in accordance with the methodology depicted via the flow chart shown in FIG. 21. The bulk net material is first cut into the desired shape, step 460. The weights are then attached to the leader lines of the net as shown in FIG. 16. Eight weights, as shown for weight 26, are attached to each corner of the octagon shaped net via one inch leader lines and eight additional weights are attached to each side of the net as shown for weight 28, step 462, FIG. 21. A two inch wide nylon cloth perimeter strip 399, FIG. 16, is then woven around the perimeter of the net, step 464, FIG. 21. Perimeter strip 399 reduces the snapback effect of the net during deployment and also causes a flotation effect for net 34 during deployment.

Figure 17:
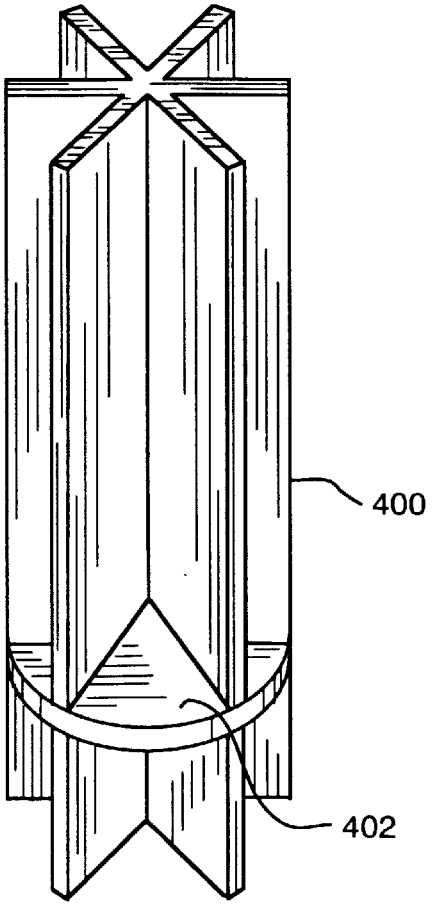
FIG. 17 is a schematic view a separator unit used to package the restraining net of this invention within a cartridge.

48" long aluminum separator unit 400, FIG. 17, is then used, step 466, as follows. Each pair of weights, as shown for weights 26 and 28, FIG. 16, are held together and. placed in a channel abutting bottom ring 402 of separator unit 400, FIG. 17. Separator unit 400, FIG. 17, is then hung vertically, step 470, FIG. 21. The tendrils of the net are then aligned and taped in the appropriate sectors of separator unit 400, step 472, FIG. 21. A piece of duct tape may then be placed about the weights and bottom ring 402 to keep them from sliding, step 468, FIG. 21.

Figure 19:
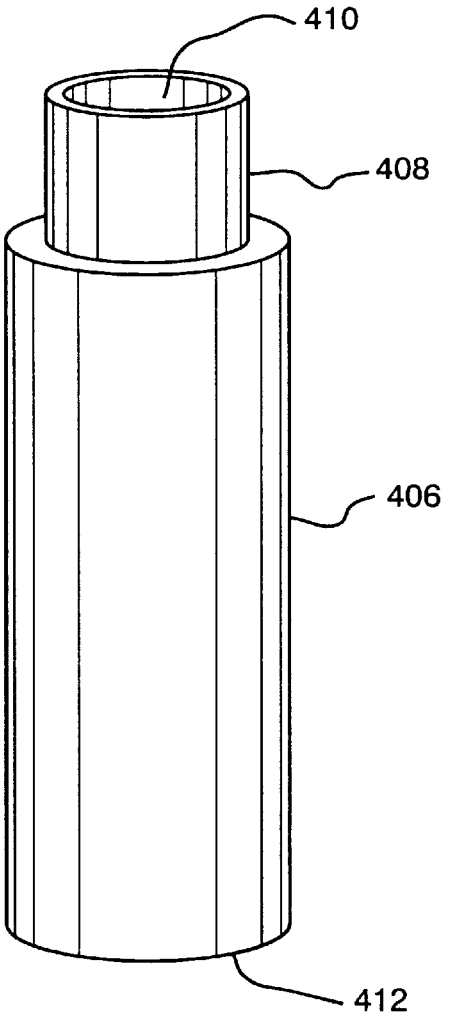
FIG. 19 is a schematic view of an acrylic tube used to package the restraining net of this invention for deployment.

A piece of heat shrinkable plastic in the form of a sleeve which will eventually become covering 76, FIG. 4, is then placed over the reduced diameter end 408 of acrylic tube 406, FIG. 19. Tube 406 has a constant inner diameter of about 37 mm. The sleeve is then heat shrunk about end 408 in all areas except the very top which will receive the weight set. Separator 400, FIG. 17, is then inserted into end 410 of acrylic tube 406, FIG. 19. While the acrylic tube is held steady, the net is drawn through acrylic tube 406 using a vacuum connected to end 412, step 474, FIG. 21. A plunger, (not shown), is then inserted into end 412 of the acrylic tube removing separator 400 while compressing the net longitudinally until the net and weight package is fully within the heat shrinkable sleeve located about end 408 of acrylic tube 406. Once the entire net has been forced into the sleeve, the assembly is ready for compression and compression jig 420, FIG. 20. First, the duct tape is removed and the plastic sleeve is slid over the weight set and a small round plug 404 is placed between the weights to maintain the orientation, step 476, FIG. 21. The plastic sleeve is then removed from acrylic tube 406, FIG. 19, and the plastic sleeve now fully surrounds the net and the weights.

Figure 20:
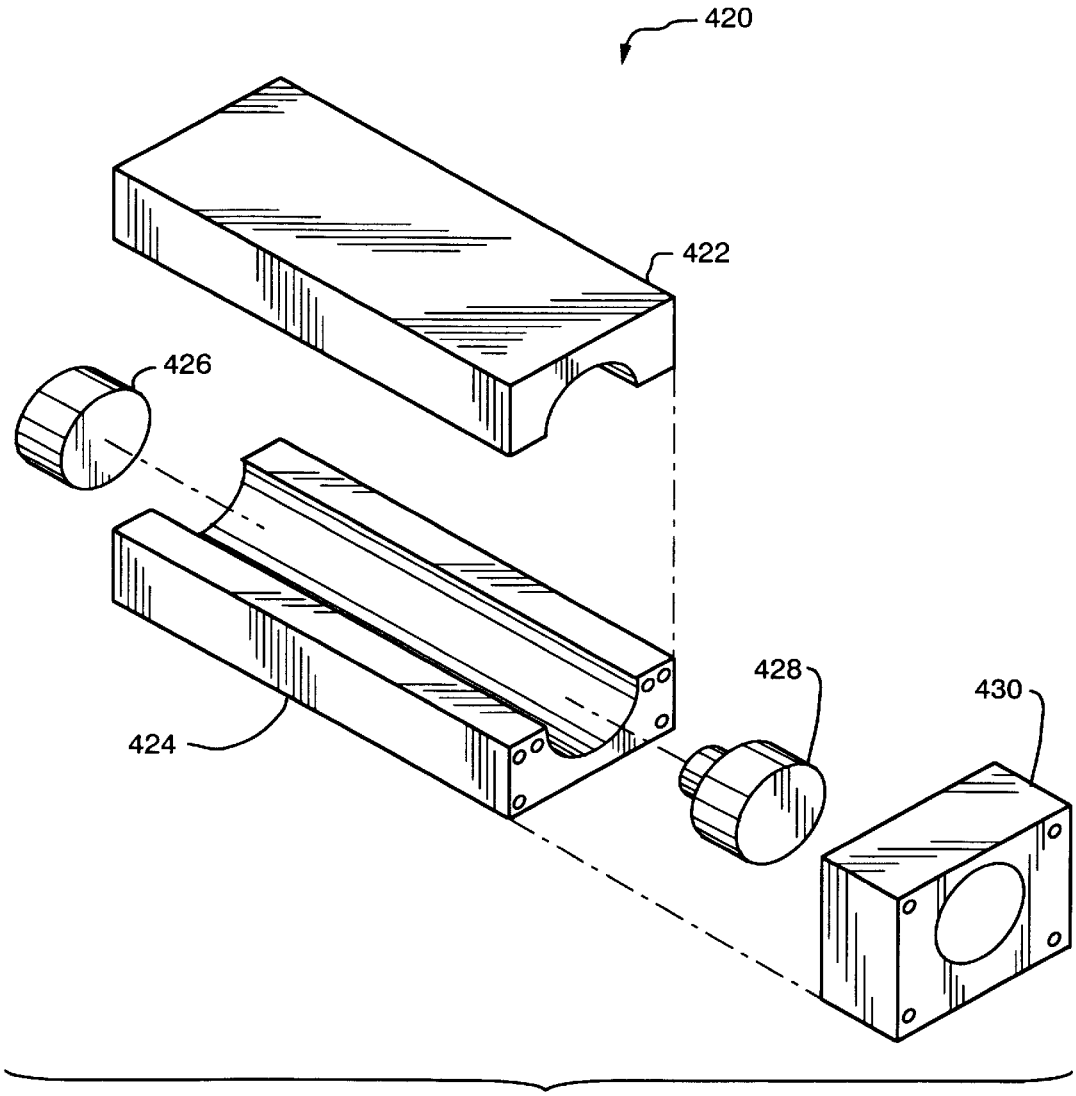
FIG. 20 is a schematic view of a compression jig used to package the restraining net of this invention for deployment.

Plastic spacer disk 426, FIG. 20, is placed in the plastic tube abutting the net. Two opposing strips of duct tape are used to secure spacer disk 426 within the heat shrinkable plastic sleeve to keep it from wrinkling. This assembly is then placed in lower half 424 of jig 420 and end plug 428 is inserted so that it abuts the weights. The other half 422 of the compression jig is then coupled to lower half 424 and end plug cover 430 is secured to this assembly to maintain the position of end plug 428 during compression. Jig 420 is then placed in a press such as a Enerpack Press from Applied Power Industry and a pressure rod (not shown) is placed against spacer disk 426 and subjected to a pressure of about 8 psi for five minutes, step 480, FIG. 21.

The pressure is then released, plug 428 is removed, along with the duct tape securing it and a heat gun is used to heat shrink the end of the plastic sleeve about the weight package. Disk 426 is then removed, a paper wafer is inserted in the plastic sleeve abutting the net, and the heat gun is then used to heat shrink the plastic sleeve about the paper wafer and the nets.

Finally, is smaller Kapton disk is pressed in between the weights to protect them and their leader lines from heat caused by spreader charge 38, FIG. 4. The plastic sleeve is trimmed as necessary, and the projectile is now ready for insertion along with spreader charge 38 and plastic plug 70 into cartridge 12, FIG. 4, step 482, FIG. 21.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A method of packaging a restraining net, the method comprising:

attaching weights to the restraining net;

positioning the weights about a separator to maintain a proper orientation of the weights;

drawing the net longitudinally with a lengthy hollow member;

inserting the separator and weights into the lengthy hollow member;

removing the separator from the lengthy hollow member; and compressing the net longitudinally and circumferentially into a bullet shape wherein the weights are located in a rear portion of said bullet shape.

2. The method of claim 1 in which the step of compressing the net includes using a plunger receivable within the hollow member.

3. The method of claim 2 in which compressing the net further includes removing the net from the hollow member and placing it in a press.

* * * * *

UNITED STATES PATENT AND TRADEMARK OFFICE

CERTIFICATE OF CORRECTION

PATENT NO. : 5,988,036
DATED : November 23, 1999
INVENTOR(S) : Mangolds et al.

It is certified that error appears in the above-identified patent and that said Letters Patent is hereby corrected as shown below:

Column 1,
Line 11, insert the following:

-- GOVERNMENT INTEREST

This invention was made with Government support under Contract No. DAAE30-95-C-0061 awarded by the U.S. Army. The Government has certain rights to this invention. --

Signed and Sealed this

Twenty-second Day of July, 2003

JAMES E. ROGAN
*Director of the United States Patent and Trademark Office*